US005227758A

United States Patent [19]

Ranjan

[11] Patent Number: 5,227,758

[45] Date of Patent: Jul. 13, 1993

[54] BAYONET-TYPE FUSE AND FUSEHOLDER ASSEMBLY

[75] Inventor: Radhakrishna Ranjan, Hickory, N.C.

[73] Assignee: General Electric Company, Malvern, Pa.

[21] Appl. No.: 948,663

[22] Filed: Sep. 22, 1992

[51] Int. Cl.[5] ..... H01H 85/02; H01H 85/14

[52] U.S. Cl. ..... 337/204; 361/41

[58] Field of Search ..... 337/204; 361/41

[56] References Cited

U.S. PATENT DOCUMENTS 4,625,196 11/1986 Muench et al. ..... 337/204

OTHER PUBLICATIONS

Brochure of General Electric Co., Hickory, N.C., entitled "Bayonet Fuseholder", Publication No. PEP80.12, dated Dec. 1980 (8 pages).

Publication of RTE Corp., 1900 E. North St., Waukesha, WI 53186, entitled RTE EL Bay-O-Net Current Limiting Fuse Holder, Section 640; undated but published prior to 1989 (2 pages).

*Primary Examiner*—Harold Broome

*Attorney, Agent, or Firm*—Henry J. Policinski; William Freedman

[57] ABSTRACT

A tubular fuseholder housing carries two sets of generally-stationary contacts located at points spaced apart along the length of the housing. Within the housing is a fuse comprising a cartridge and, at opposite ends of the cartridge, terminal contacts for respectively engaging the stationary contacts when the cartridge is fully inserted into the housing. An insulating operating rod within the fuseholder housing is coupled to the fuse cartridge and extends toward the outer end of the housing.

Actuation of the operating rod separates the terminal contacts from the generally-stationary contacts and draws electric arcs between these contact. Closely adjacent the individual contacts of each set of stationary contacts and angularly aligned with the individual contacts, supplemental exhaust ports are provided in the fuseholder housing. The fuseholder housing normally contains dielectric liquid covering the fuse which is vaporizable by the arcs to generate gases that are exhausted through the supplemental ports. Actuation of the fuse cartridge from its fully-inserted position toward its disconnected position produces a pumping action within the fuseholder housing that forces liquid within the housing through the regions of said arcs and out the supplemental ports.

4 Claims, 2 Drawing Sheets

BAYONET-TYPE FUSE AND FUSEHOLDER ASSEMBLY

TECHNICAL FIELD

This invention relates to a bayonet-type fuse and fuseholder assembly and, more particularly, to an assembly of this type that includes means for reducing the arcing duty imposed upon the components of the assembly when the fuse is disconnected from the fuseholder under load-break conditions.

BACKGROUND

In a bayonet-type fuse and fuseholder assembly, there are a tubular fuseholder housing of electrical insulating material and two sets of generally-stationary spring-loaded contacts mounted on the housing in locations spaced apart along the length of housing. Within the fuseholder housing there is a removable fuse cartridge enclosing a fuse link and having terminal contacts at its opposite ends for respectively engaging the stationary contacts to establish a circuit through the fuse link between the stationary contacts. The fuse cartridge is mounted on the distal end of an insulating operating rod that is also located within the fuseholder housing and is operable to effect a disconnect operation that separates the terminal contacts of the fuse cartridge from the stationary contacts that normally engage them, thereby developing arcs between the separated contacts under load-break conditions.

These arcs, being very hot, tend to produce arc erosion of the contacts, burning of the springs loading the stationary contacts, and carbonization of nearby insulating material, thus limiting the number of disconnecting operations that can be effected before it becomes necessary to replace one or more of these components in order to prevent a failure. A type of failure that can occur is one resulting from carbonization of the internal surface of the fusehold housing. Such carbonization can lead to an arc-over between the generally stationary contacts when the fuse is removed from its normal position between these contacts.

An object of my invention is to reduce the damaging effect of the arcs and thereby increase the number of disconnecting operations that can be effected under load-break conditions without a failure.

SUMMARY

In carrying out the invention in one form, I provide a tubular fuseholder housing primarily of electrical insulating material and having inner and outer ends. Two sets of generally stationary contacts are mounted on said housing, a first set being located at the inner end of the housing and a second set in a region intermediate the ends of the housing. Within said housing is a fuse comprising (i) a tubular fuse cartridge of insulating material, (ii) a pair of spaced-apart terminal contacts located at opposite ends of the fuse cartridge respectively engaging said first and second sets of stationary contacts when the fuse is fully inserted, and (iii) a conductive fuse link extending between said terminal contacts within the fuse cartridge. Extending between the fuse cartridge and the outer end of the fuseholder housing is an operating rod of insulating material having an inner end coupled to the fuse cartridge. The operating rod is operable to drive the fuse cartridge in an opening direction from its fully-inserted position toward a disconnected position located adjacent the outer end of the fuseholder housing, thereby drawing electric arcs between the then-separated contacts. Exhaust gas ports are provided within the fuseholder housing in a location between the second set of stationary contacts and the outer end of the fuseholder housing for venting from this housing gases produced by a circuit-interrupting operation of the fuse.

A first set of supplemental ports is provided within the fuseholder housing in a location between the second set of stationary contacts and said exhaust gas ports, and these supplemental ports are disposed substantially in angular alignment with the angularly-spaced stationary contacts in said second set of stationary contacts. A second set of supplemental ports is provided within the fuseholder housing in a location closely adjacent said first set of stationary contacts and in substantial angular alignment with the angularly-spaced contacts in said first set of stationary contacts.

The fuseholder housing normally contains dielectric liquid covering the fuse and vaporizable by the above-described arcs to generate gases that are exhausted through said supplemental ports. In addition to producing the above-described arcs, actuation of the fuse cartridge from its fully-inserted position toward its disconnected position produces a pumping action within the fuseholder housing which forces liquid within the housing through the regions of said arcs and out said supplemental ports.

BRIEF DESCRIPTION OF FIGURES

For a better understanding of the invention, reference may be had to the following detailed description taken in connection with accompanying drawings, wherein.

DETAILED DESCRIPTION OF EMBODIMENT

Figure 1:
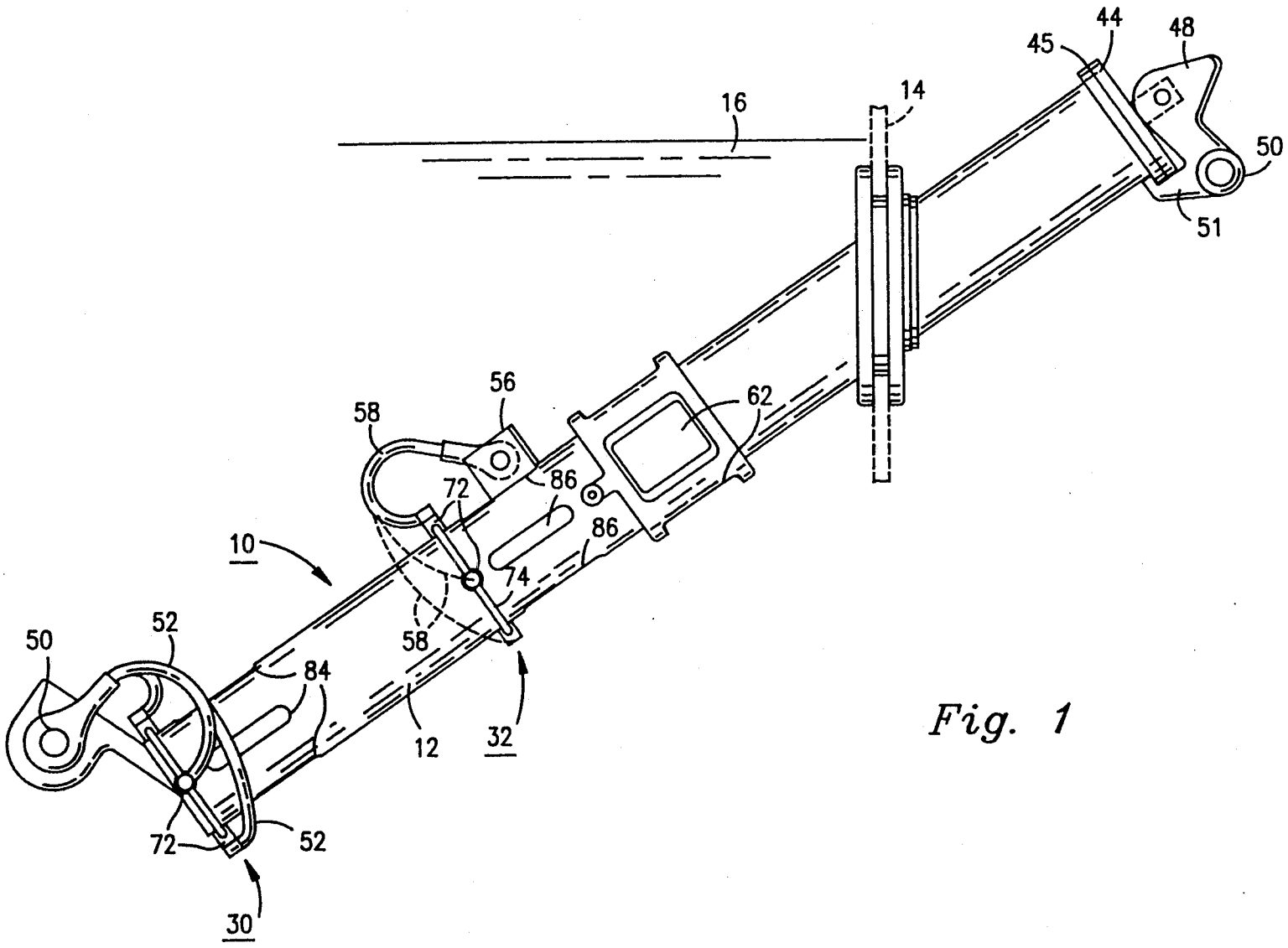
FIG. 1 is a side elevational view of a bayonet type fuseholder showing how the fuseholder is oriented when installed in electrical apparatus.

Referring now to FIG. 1, the fuseholder 10 shown therein comprises a elongated tubular housing 12 primarily of electrical insulating material. This housing 12 is arranged to project through a sidewall 14 of electrical apparatus, such as a transformer, at an angle, typically, of about 40–50 degrees with respect to the horizontal. The transformer contains liquid dielectric 16, such as mineral oil, within which the housing 12 is immersed.

Figure 2:
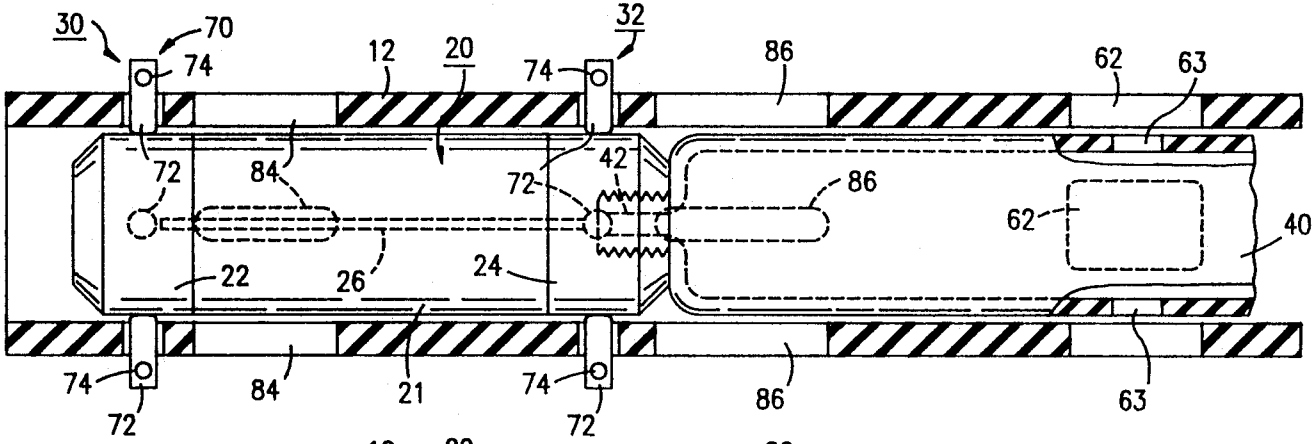
FIG. 2 is a sectional view of a portion of the assembly showing the fuse cartridge in the fully inserted position within the fuseholder housing. For simplicity, the parts are shown horizontally oriented.
Figure 3:
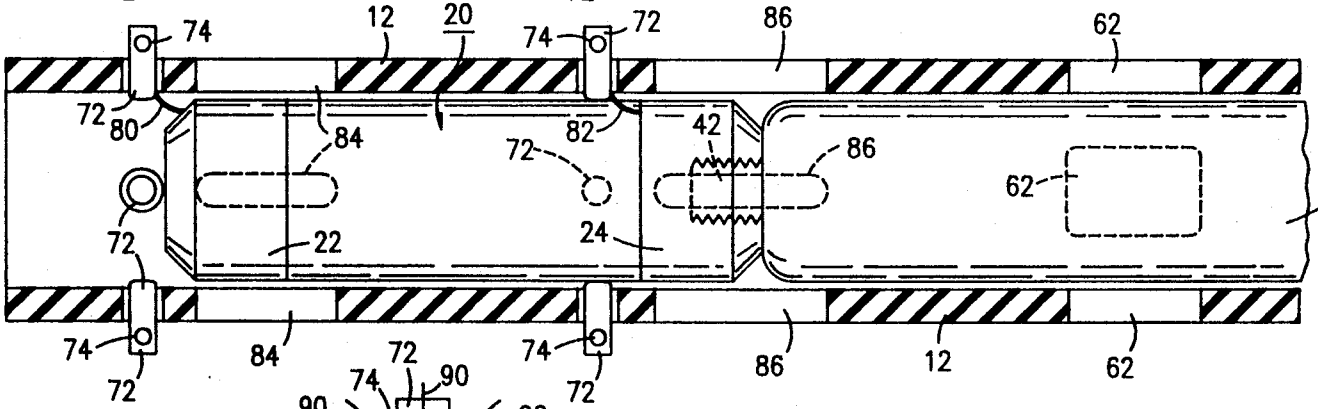
FIG. 3 is a sectional view of the components of FIG. 2 showing such components during a fuse-cartridge-disconnecting operation that establishes arcs at the two terminal contacts of the fuse cartridge.

Referring next to FIGS. 2 and 3, the fuseholder housing 12 is adapted to receive within its interior a fuse 20 of conventional form that is inserted into housing 12 through an opening in its outer end. In one embodiment of the invention, fuse 20 is a cartridge-type of expulsion fuse, a typical form of which is disclosed in U.S. Pat. No. 4,625,196—Muench et al. This fuse comprises a tubular fuse cartridge 21 of electrical insulating material and a pair of conductive terminal contacts 22 and 24 mounted on the fuse cartridge at opposite ends of the fuse cartridge. Electrically connected between the terminal contacts 22 and 24 and disposed within the fuse cartridge 21 is a fusible link 26 which melts or vaporizes in response to an overcurrent therethrough, thereby initiating a circuit-interrupting operation in a conventional manner.

The fuse 20 when fully inserted into the housing 12 of the fuseholder is positioned at the lower, or inner, end of the housing 12. In this position, depicted in FIG. 2, the terminal contacts 22 and 24 of the fuse cartridge are respectively engaged by two sets 30 and 32 of generally stationary contacts mounted on the fuseholder housing. One set 30 of the generally stationary contacts is located near the inner end of the fuseholder housing 12, and the other set 32 is located in a region intermediate the ends of the housing 12.

For inserting the fuse 20 into its position between the two sets of generally stationary contacts 30 and 32, a tubular operating rod 40 of electrical insulating material is provided. The fuse cartridge 21 is suitably mechanically connected to the inner, or distal, end of the operating rod 40, as by a hollow threaded connection 42 at the top of the fuse cartridge. The operating rod 40 extends from the fuse cartridge through the hollow upper portion of the fuseholder housing and carries at its upper end a cap 44 that is clamped against a suitable resilient seal 45 at the upper end of the fuseholder housing. Also present at this upper end of the operating rod are a cam 48 that is used for compressing the seal and an operating hook eye 50 coupled to the cam for receiving a hook-stick for releasing the cam and actuating the operating rod. The parts 44, 45, 48, and 50 are of a conventional design and operate in a conventional manner to close off the upper end of the fuseholder housing and to provide a releasable latch 51 for holding the operating rod in its fully-inserted position under normal conditions.

As seen in FIG. 1, one of the sets 30 of generally-stationary contacts is connected to a first terminal 50 of the fuseholder through a plurality of braids 52. The other set 32 of generally stationary contacts is connected to a second terminal 56 of the fuseholder through a second plurality of braids 58. Accordingly, when the fuse 20 is in its fully inserted position current flows between fuseholder terminals 50 and 56 via the series combination of braids 52, stationary contacts 30, the fuse 20, stationary contacts 32, and braids 58. Typically, the terminals 50 and 56 are connected in series with the primary winding of the transformer so that the fuse can protect the transformer against excessive currents.

Should the fuse be subjected to a short-circuit current or a protracted overcurrent, its fusible link 26 will melt or vaporize, creating an electric arc which reacts with the surrounding oil and insulating material to develop gases or vapors. These gases or vapors are vented from the fuseholder through a plurality of large exhaust ports 62 located in the mid-region of the fuseholder housing 12, a well as through the open lower end of the housing 12. There are vents (not shown) in each end of the fuse cartridge 21 that enable these gases or vapors to exhaust from the fuse cartridge. Gases exhausting through the upper end of the fuse cartridge are able to flow into the interior of hollow operating rod 40 and to exit from this interior via radially-extending passages 63 that are aligned with the large exhaust ports 62.

In the illustrated embodiment, each set 30 and 32 of stationary contacts comprises four generally stationary contacts 70 that are mounted on the fuseholder housing 12 in angularly-spaced locations about the circumference of housing 12. Each of these generally-stationary contacts comprises a finger 72 slidably mounted in a radially-extending hole 73 in housing 12 and biased radially inwardly by a circular of spring 74 that surrounds housing 12 and is suitably coupled to the fingers 72. The spring 74 also limits the extent of the radial motion that is allowed for the fingers 72. When the fuse cartridge 21is in its fully inserted position of FIG. 2, the contact fingers 72 in the contact set 30 engage the inner terminal contacts 22 of the fuse, and the fingers in the contact set 32 engage the outer terminal contact 24.

When it is desired to withdraw the fuse 20 from its fully-inserted position of FIG. 2, the operating rod 40 is moved to the right, thereby carrying the fuse cartridge 21 to the right. During the initial portion of this motion to the right, the fingers 72 slide on the metal terminal contacts 22 and 24. But after a short amount of rightward travel, the terminal contacts 22 and 24 separate from their respective contacts fingers 72, thereby drawing arcs 80 and 82 at the two terminal contacts.

These arcs 80 and 82, being very hot, tend to erode the adjacent contacts and the springs 74 and to carbonize the nearby electrical insulating material. This is a cumulative effect which after repeated disconnecting operations causes sufficient damage to require replacement of some or all of these parts to avoid a failure.

In prior designs of this fuseholder assembly, the housing 12 has been essentially imperforate in the region between the two sets 30 and 32 of stationary contacts and also in the region between the stationary contact set 32 and the large exhaust ports 62 that are used for venting the gases developed upon melting or vaporization of the fuse link 26 during a circuit-interrupting operation. I have found that this imperforate construction tends to seriously limit the number of load-break disconnect operations that can be effected without causing a failure. In such a design, arcs such as 80 and 82 have prematurely caused damage to the springs 74, the contacts 72, 22 and 72, 24, or have prematurely produced carbonization of the internal surface of tubular housing 12.

I have been able to substantially reduce the damaging effect of arcs such as 80 and 82 by providing the fuseholder housing 12 with supplemental venting ports located closely adjacent the contact members 72 of the fuseholder. Adjacent the contact members 72 of the set 30, I provide supplemental venting ports 84 that are angularly-aligned with these contact members; and adjacent the contact members 72 of set 32, I provide supplemental venting ports 86 that are angularly-aligned with these latter contact members. These supplemental ports 84 and 86 take the form of slots that extend lengthwise of the tubular housing 12. Supplemental ports 86, it is noted, are located between the stationary contact set 32 and the large exhaust ports 62.

Figure 4:
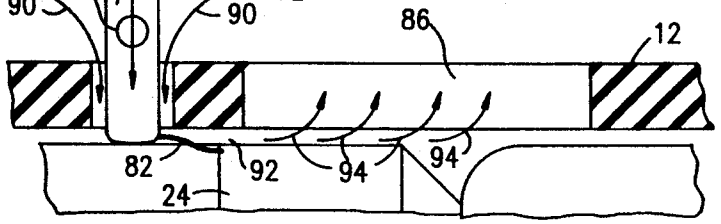
FIG. 4 is an enlarged view of a portion of the assembly showing the parts at the instant depicted in FIG. 3 and showing certain flow relationships then present.

When the operating rod 40 is moved rapidly to the right from its position of FIG. 2 as a part of a fuse-load-break, disconnecting operation, it creates a low pressure region in its wake within the fuseholder housing 12. This results in a pumping action which draws in relatively cool liquid from outside housing 12 via paths 90 surrounding the contact members 72, as shown in the enlarged view of FIG. 4. This liquid flows through the region of arc 82, then through the narrow passage 92 between the terminal contact 24 and the bore of housing 12, then outwardly through the supplemental exhaust ports 86, as indicated by arrows 94. The arc 82 vaporizes some of the oil surrounding it, and these vapors are forced to follow essentially the same path through regions 92 and 86.

At the other set 30 of contacts, similar flow conditions prevail during the fuse-disconnecting operation.

The above-described flow of oil cools the arcs, shortening the arcing period, and sweeping arc products away from the contacts and out through the supplemental venting ports 84 and 86. This action contributes to reduced arc-erosion of the metal parts and less carbonization of the insulating parts in the region of the arc. I have found that with the ports 84 and 86 present, I can increase the number of fuse-load-break disconnecting operations before a failure by about 200 to 300% as compared to the performance of a corresponding fuse and fuseholder without the supplemental ports when operated under corresponding current and voltage conditions.

While the large exhaust ports 62 are capable of providing some venting of the arcing products from arcs 80 and 82 during a fuse-disconnecting operation, their effectiveness for this purpose is limited by their remoteness from these arcs and by the highly restricted character of the flow path leading from these arcs to the large exhaust ports 62.

The angularly-aligned relationship of the supplemental exhaust ports 84 and 86 with respect to their associated contacts 72 significantly contributes to the effectiveness of these supplemental ports in producing a pattern of flow that cause the oil to pass through the region of arcs 80 and 82. In tests made with the supplemental ports angularly offset by 45 degrees from the contacts 72, the supplemental ports were substantially less effective in reducing arcing damage.

While I have shown and described a particular embodiment of my invention, it will be obvious to those skilled in the art that various changes and modification may be made without departing from my invention in its broader aspects; and I, therefore, intend herein to cover all such changes and modifications a fall within the true spirit and scope of my invention.

What I claim is:

1. A bayonet-type fuse and fuseholder assembly comprising:

(a) a tubular fuseholder housing primarily of electrical insulating material and having an inner end and outer end, (b) a first set of generally-stationary contacts mounted on said tubular fuseholder housing and located near said inner end of said tubular housing, said contacts being situated at angularly-spaced locations about said tubular housing, (c) a second set of generally-stationary contacts mounted on said tubular fuseholder housing and located in a region intermediate the ends of said tubular housing, said contacts of said second set being situated at angularly-spaced locations about said tubular housing, (d) a fuse insertable within said tubular fuseholder housing and comprising: (i) a tubular fuse cartridge of electrical insulating material, (ii) a pair of spaced-apart terminal contacts located at opposite ends of said fuse cartridge, one of said terminal contacts being engageable by said first set of stationary contacts and the other of said terminal contacts being engageable by said second set of stationary contacts when said fuse is fully inserted into said fuseholder housing, and (iii) a conductive fuse link extending between said terminal contacts within the fuse cartridge, (e) a rod primarily of electrical insulating material extending between said fuse and the outer end of said fuseholder housing, said rod having an inner end mechanically coupled to said fuse cartridge and an outer end operable to drive said fuse in an opening direction from its fully-inserted position toward a disconnected position located adjacent the outer end of said fuseholder housing, thereby drawing a first electric arc between said first set of stationary contact and the terminal contact engaged thereby and a second electric arc between said second set of stationary contacts and the terminal contact engaged thereby, (f) an exhaust gas port within said fuseholder housing in a location between said second set of stationary contacts and said outer end of the fuseholder housing for venting from said fuseholder housing gases produced by a circuit-interrupting operation of said fuse, (g) a set of supplemental ports within said fuseholder housing located between said second set of stationary contacts and said exhaust gas port, the supplemental ports of said first set being respectively positioned substantially in angular alignment with said stationary contacts of said second set of stationary contacts, and in which:

(h) said fuseholder housing normally contains dielectric liquid covering said fuse cartridge and vaporizable by said second arc to generate gases that are exhausted through said supplemental ports, and (i) actuation of said fuse cartridge from its fully-inserted position toward its disconnected position produces a pumping action which forces liquid within said fuseholder housing through the region of said second arc and out said supplemental ports.

2. The assembly of claim 1 in which:

(a) a second set of supplemental ports is provided within said fuseholder housing, said second set of supplemental ports being located adjacent said first set of stationary contacts and substantially in angular alignment with the stationary contacts of said first set of stationary contacts, (b) said first arc vaporizes said dielectric liquid to generate gases that are exhausted through said second set of supplemental ports, and (c) said pumping action forces liquid within said fuseholder housing through the region of said first arc and out said second set of supplemental ports.

3. The assembly of claim 1 in which said supplemental ports are in the form of slots within said fuseholder housing extending lengthwise of said fuseholder housing.

4. The assemby of claim 2 in which said supplemental ports are in the form of slots within said fuseholder housing extending lengthwise of said fuseholder housing.

* * * * *